US005863026A

United States Patent [19]

Gano et al.

[11] Patent Number: 5,863,026

[45] Date of Patent: Jan. 26, 1999

[54] VEHICLE RAMP

[75] Inventors: Barry T. Gano; Douglas Umbs, both of Salem; Robert K. Richardson, Minerva, all of Ohio

[73] Assignee: Ganeaux Industries, Inc., Salem, Ohio

[21] Appl. No.: 893,750

[22] Filed: Jul. 11, 1997

[51] Int. Cl.[6] ..... B66F 3/00

[52] U.S. Cl. ..... 254/88

[58] Field of Search ..... 254/88; 14/71.5

[56] References Cited

U.S. PATENT DOCUMENTS

| | | | |
|---|---|---|---|
| D. 228,301 | 9/1973 | Lundman | D41/1 C |
| D. 232,020 | 7/1974 | Borsuk | D12/53 |
| D. 237,162 | 10/1975 | Miller | D12/53 |
| D. 239,610 | 4/1976 | Miller | D12/53 |
| D. 313,102 | 12/1990 | Cano | D34/32 |
| 1,706,919 | 3/1929 | Erickson et al. . | |
| 1,726,988 | 9/1929 | Klein . | |
| 1,904,693 | 4/1933 | Myers et al. . | |
| 2,160,770 | 5/1939 | Weller . | |
| 2,279,464 | 4/1942 | Jackson . | |
| 2,450,648 | 10/1948 | Felzer . | |
| 3,638,910 | 2/1972 | Nellis et al. . | |
| 3,847,376 | 11/1974 | Binding . | |
| 3,870,277 | 3/1975 | West . | |
| 3,917,227 | 11/1975 | West . | |
| 4,013,268 | 3/1977 | Williams . | |
| 4,050,403 | 9/1977 | Miller | 116/124 R |
| 4,421,300 | 12/1983 | Lundman | 254/88 |
| 4,845,792 | 7/1989 | Bakula et al. | 14/69.5 |
| 4,920,596 | 5/1990 | Stevens | 14/69.5 |
| 5,118,081 | 6/1992 | Edelman | 254/88 |
| 5,141,076 | 8/1992 | Joyce et al. | 182/108 |
| 5,176,361 | 1/1993 | Ayala, III | 254/88 |
| 5,324,004 | 6/1994 | Richardson | 254/88 |
| 5,361,868 | 11/1994 | Bartos | 182/111 |
| 5,446,937 | 9/1995 | Haskins | 14/69.5 |
| 5,716,040 | 2/1998 | Torres | 254/88 |

*Primary Examiner*—David A. Scherbel
*Assistant Examiner*—Lee Wilson
*Attorney, Agent, or Firm*—Sand & Sebolt

[57] ABSTRACT

An improved vehicle ramp is formed to eliminate interference between the vehicle spoilers and the ramp by extending the ramp when assembled such that the ramp has a lesser angled or sloped inclined surface. The improved vehicle ramp is further formed to eliminate ramp sliding as the vehicle is driven onto and up the ramp. Finally, the improved vehicle ramp eliminates knifing into the ground under loading. The improved vehicle ramp includes a base ramp with a base plate under its vertical edge. The improved vehicle ramp further includes a ramp extension secured to the base of the base ramp incline, and a ramp transition secured between the ramp extension and base ramp for providing a lesser sloped incline with a gradual entrance angle. The ramp extension, ramp transition, and base plate from two improved vehicle ramps are packageable in a compact nature for shipping, display and storage.

20 Claims, 9 Drawing Sheets

VEHICLE RAMP

BACKGROUND OF THE INVENTION

1. Technical Field

The invention relates to vehicle ramps of the type for supporting one wheel of a vehicle sufficiently clear of the ground to enable a person to slide under the vehicle for underside inspection and/or repair purposes. More particularly, the invention relates to a vehicle ramp (1) having an elongated, lesser sloped grade, that provides sufficient clearance between the vehicle, and particularly its spoilers, and the ramp during said positioning, (2) that is less susceptible to sliding during positioning of the vehicle thereon, and (3) that is less susceptible to sinking into any soft ground surface when loaded with a vehicle thereon. Specifically, the invention relates to a multiple piece vehicle ramp system that includes a base ramp with a ramp extension connectable thereto, and a ramp transition connectable therebetween in a bridging manner whereby the ramp extension and transition eliminate ramp sliding and interfering with the vehicle during positioning of the vehicle up the ramp extension and transition onto the base ramp, and where the invention includes a base plate that reduced or eliminates sinking of the front of the base ramp into any soft ground surface when loaded. This invention is also packageable in a compact and interlocking manner.

2. Background Information

Many vehicle owners perform routine maintenance and repairs on their vehicles. In order to gain easy access to the underside of the vehicle they will elevate either the front or rear portion of the vehicle on which they are working to provide such access. Various portable ramps have been used by amateur auto mechanics and vehicle owners for this purpose. These ramps are usually formed of metal and have various configurations to enable the vehicle wheel to be driven up an inclined portion of the ramp, after which it settles into a wheel retaining area of the ramp.

Prior examples of such metal ramps are shown in U.S. Pat. Nos. 2,279,464, 2,450,648, 3,638,910, 3,847,376, 3,870,277, 3,917,227, 4,421,300, 4,050,403, 4,845,972, 4,920,956, 5,324,004, and 5,446,937; and in U.S. Pat. Nos. D 228,301, D 232,020, D 237,162, D 239,610 and D 313,102.

Although many of these prior art ramps were satisfactory for their intended purpose, several disadvantages or problems occur when used in conjunction with either certain newer model vehicles with low front and/or rear spoilers, or in certain ground conditions such as sand, wet, dirt, or mud, etc. Specifically, many newer model vehicles have front and/or rear spoilers that are often low enough to interfere with the needed vehicle-ramp clearance that enables the vehicle to be driven up an inclined portion of a standard ramp. This problem is shown in FIG. 1. Although these standard one-piece ramps could be redesigned and manufactured in a longer version with a more gradual incline, this is unacceptable to the shippers, retailers, and end-users because any increased bulk and weight equates to more shipping and workers compensation expense (particularly as the size and weight increases), any increased shelf space per unit equates to less display area and more storage cost, and any increased bulk and weight equates to a less user friendly product due to undesirable weight and size. It is thus desirable to design a new ramp or ramp system that is extendable so as to provide a lesser sloped grade or inclined portion while not enlarging the packaged product at all, where the initial grade is such that sliding is unlikely to occur during driving of the vehicle onto the ramp.

In addition to these slide and clearance disadvantages, many of the prior art ramps are also susceptible to sinking, often referred to as knifing, into soil, sand, clay, warm asphalt, etc. when the ramp is used on any surface other than concrete. This sinking is very dangerous because the vehicle weight will shift on the ramps and cause an off-center load condition through possible movement of ramps knifing, sinking, bending, tipping and/or flipping, resulting in the decrease of vehicle-ground clearance and/or loss of load, limb and/or life. It is thus desirable to design a new ramp or ramp system that resists such sinking or knifing.

Furthermore, it is always desirable to be able to manufacture such a ramp at a reduced cost and of a lighter weight, in order for it to be more easily handled by the user, but without sacrificing any safety to the user thereof. It is also desirable to manufacture such a vehicle ramp as a snap-fit system free of moving parts which require manipulation and are subject to breakage and maintenance.

Therefore, the need exists for an improved vehicle ramp which enables the user to drive one of the vehicle wheels along the ramp to a safe resting position without any ramp sliding or interference due to insufficient ramp-vehicle clearance, whereat the vehicle will be safely supported for subsequent repair and maintenance and not susceptible to sinking, by a lightweight, yet sturdy and durable device, free of moving parts which require extra manipulation by the user thereof, while remaining of reasonable overall size when packed in a shipping position.

SUMMARY OF THE INVENTION

Objectives of the invention include providing an improved vehicle ramp.

Another objective of the invention is to provide such a vehicle ramp with a more gradual incline, that is a longer, lesser slope on the inclined portion of the ramp.

Another objective of the invention is to provide such a vehicle ramp with this more gradual incline while still maintaining the industry standard elevation supplied by prior art ramps, that is avoiding reducing the ramp height to supply this needed more gradual incline.

Another objective of the invention is to provide such a vehicle ramp with this more gradual incline and without reduced height while not lengthening the packaged ramp since any increased overall size is undesirable for shipping, storage and display.

Another objective of the invention is to provide such a vehicle ramp where the ramp is less susceptible, and preferably not susceptible at all, to sliding as the vehicle engages the ramp and drives up the incline to the wheel retaining area as this sliding often occurs as the wheel engages the ramp, particularly in rear wheel drive vehicles that are being elevated in the front.

Another objective of the invention is to provide such a vehicle ramp that provides sufficient clearance between the vehicle and the ramp as the vehicle is driven up an inclined portion of the ramp and settles into a wheel retaining area, and more particularly provides sufficient clearance between newer model vehicles with low spoilers and the ramp.

Another objective of the invention is to provide such a vehicle ramp that provides sufficient support area so as to avoid sinking or knifing into the soil, sand, clay, or other ground surface under vehicle weight.

Another objective of the invention is to provide such a vehicle ramp which is formed with a unique series and arrangement of connectable ramp surfaces for providing the necessary length, gradual slope and entry angle to avoid ramp sliding while also providing sufficient ramp and thus vehicle height, and not increasing the overall package size.

Another objective of the invention is to provide a vehicle ramp that is safer than the current designs.

Another objective of the invention is to provide a vehicle ramp that meets all of the above-mentioned objectives.

These and other objectives and advantages of the invention are achieved by the improved vehicle ramp, the general nature of which may be stated as including a vehicle ramp system having a unitary ramp and a ramp extension.

The unitary ramp has an inclined ramp surface, a raised wheel rest surface, and a rear support. The ramp extension being selectively securable to a mid-section of the inclined ramp surface and having an inclined extension surface of a lesser incline than the inclined ramp surface.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DETAILED DESCRIPTION OF THE PREFERRED EMBODIMENT

Figure 1:
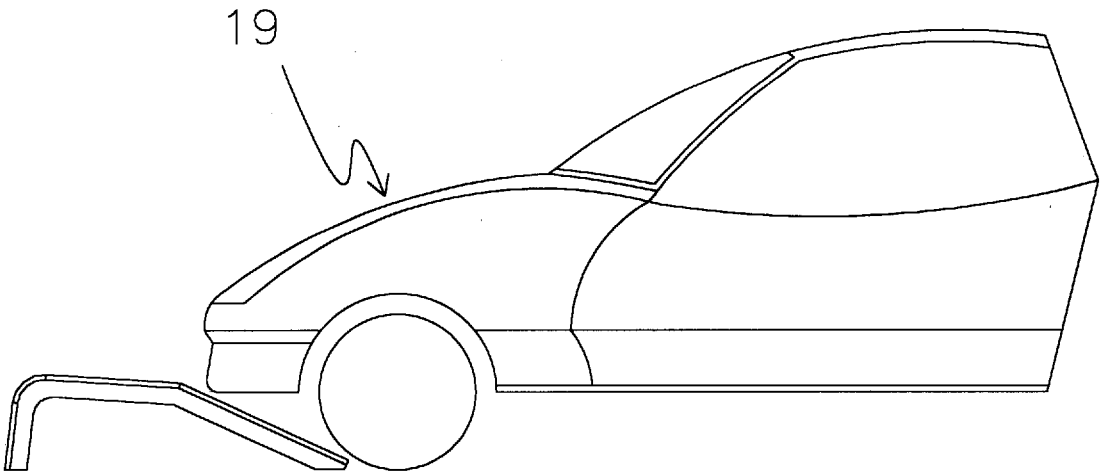
FIG. 1 is a perspective view of a prior art vehicle ramp with a car attempting to drive up the inclined portion of the ramp but being blocked by contact between the car spoiler and the ramp.
Figure 2:
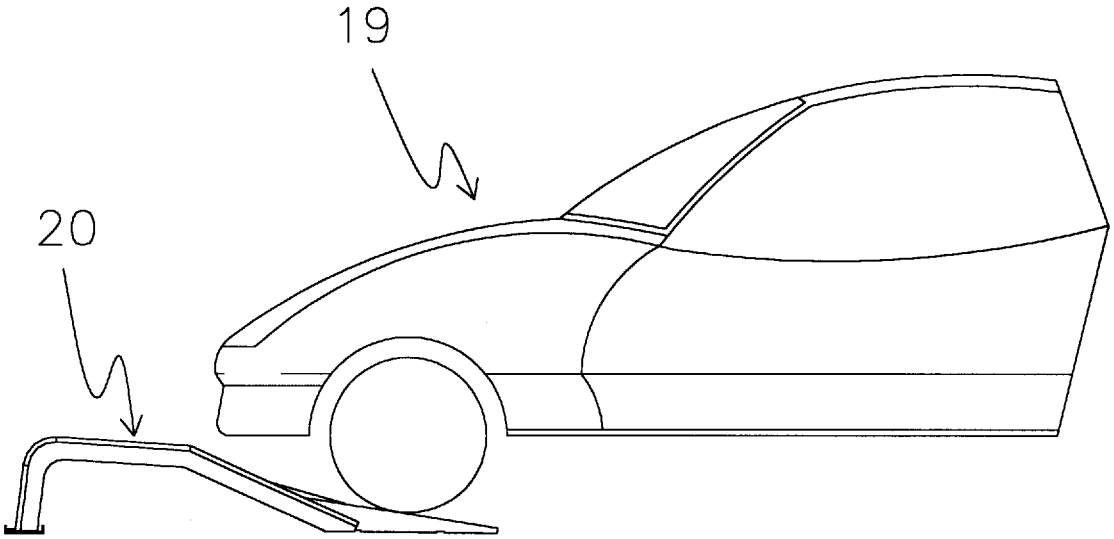
FIG. 2 is a perspective view of the improved vehicle ramp with a car partially driven up the ramp extension toward the ramp.
Figure 3:
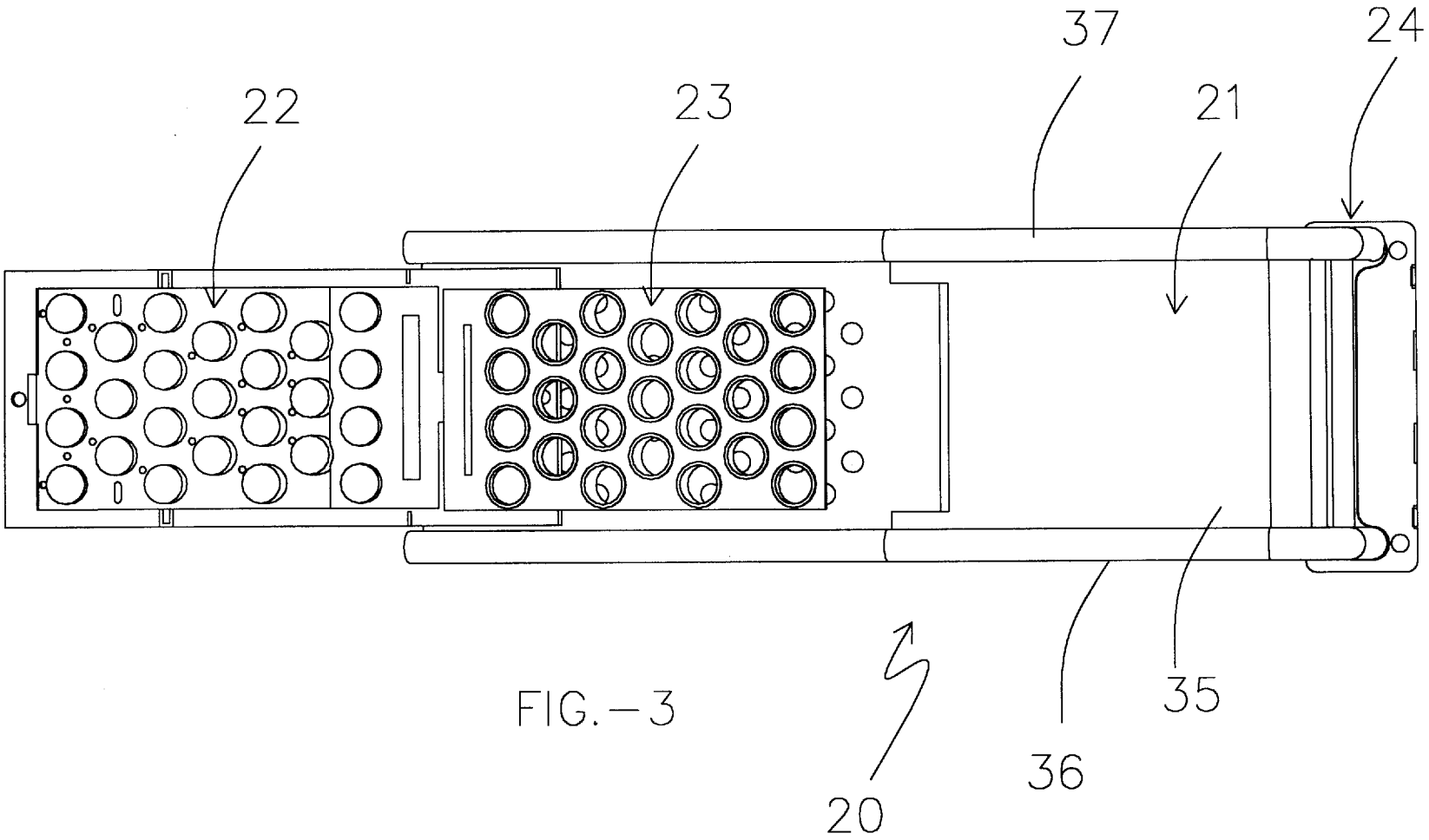
FIG. 3 is a top plan view of the improved vehicle ramp including the ramp, ramp extension, ramp transition, and base plate of FIG. 2.
Figure 4:
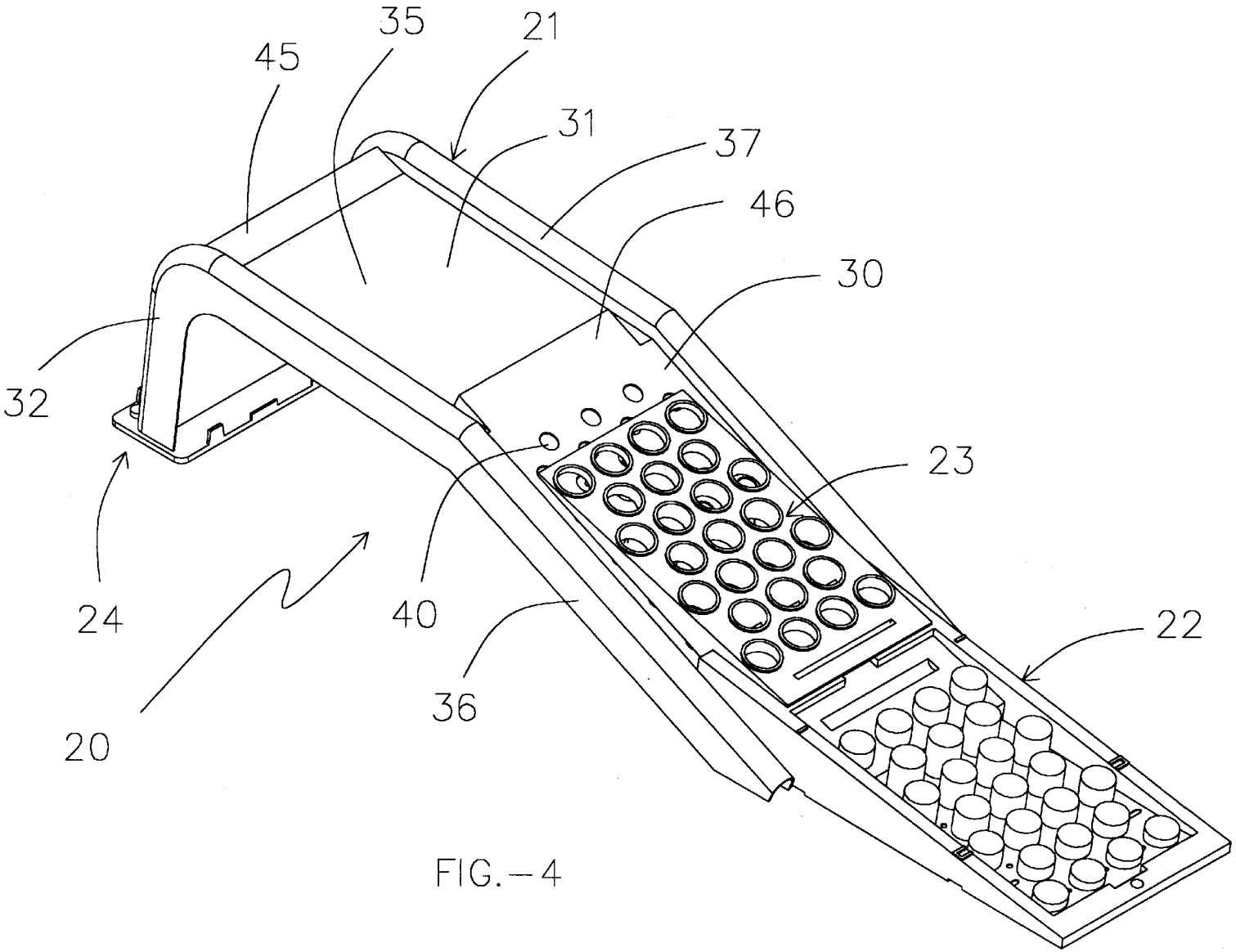
FIG. 4 is a perspective view of the improved vehicle ramp of FIG. 3.
Figure 15:
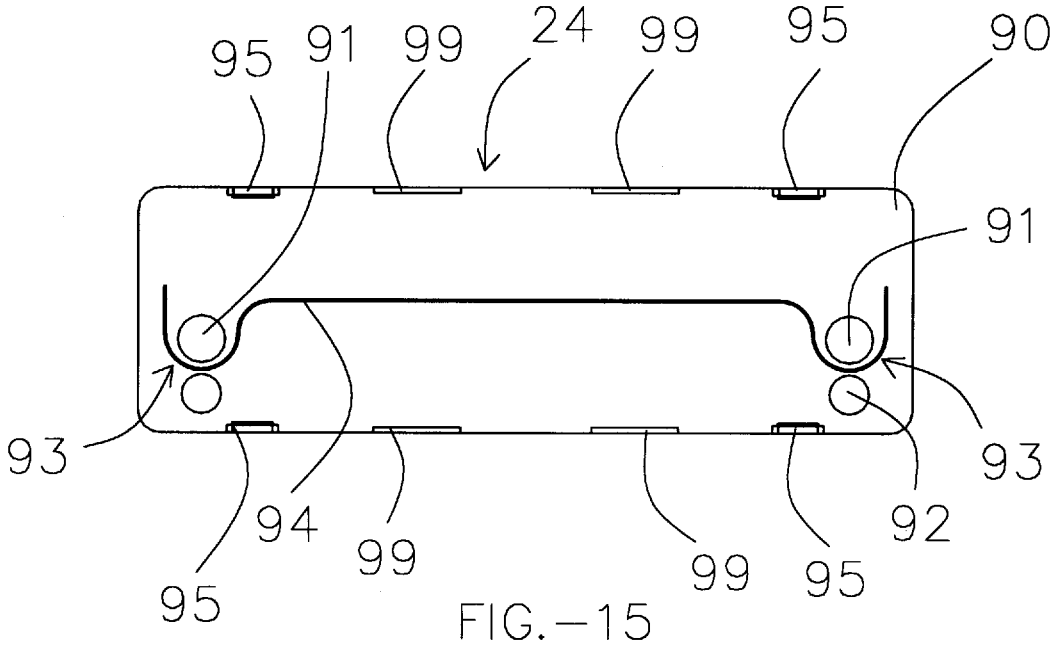
FIG. 15 is a top plan view of the base plate of FIGS. 2–4.
Figure 16:
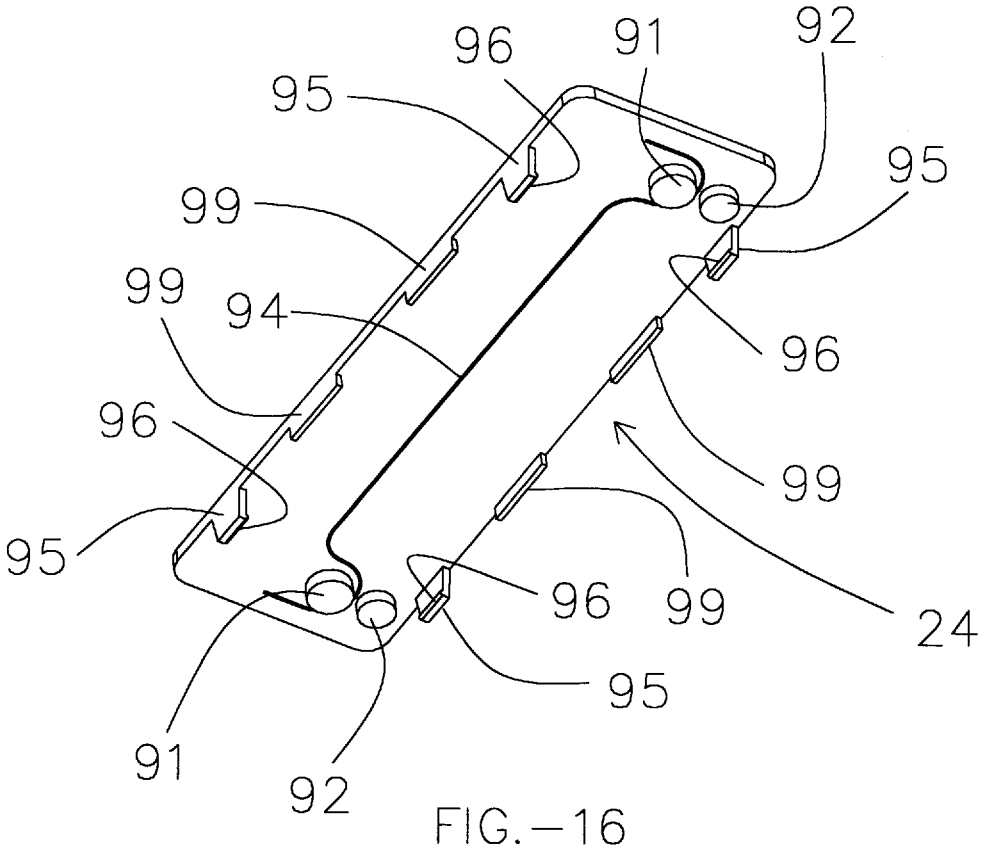
FIG. 16 is a perspective view of the base plate of FIG. 15.
Figure 17:
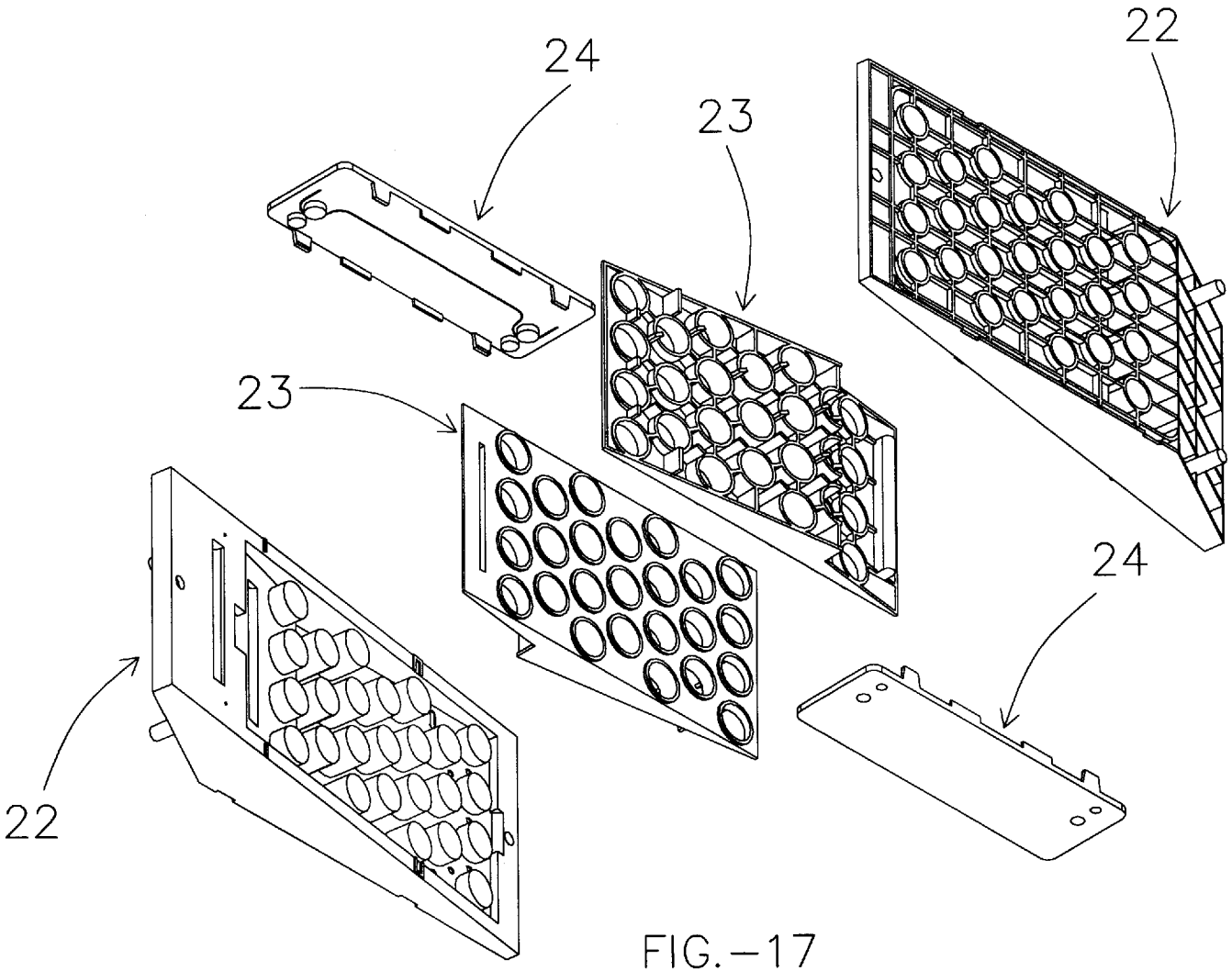
FIG. 17 is an exploded perspective view of the improved vehicle ramp of FIGS. 2–4 exploded open from a packed position.
Figure 18:
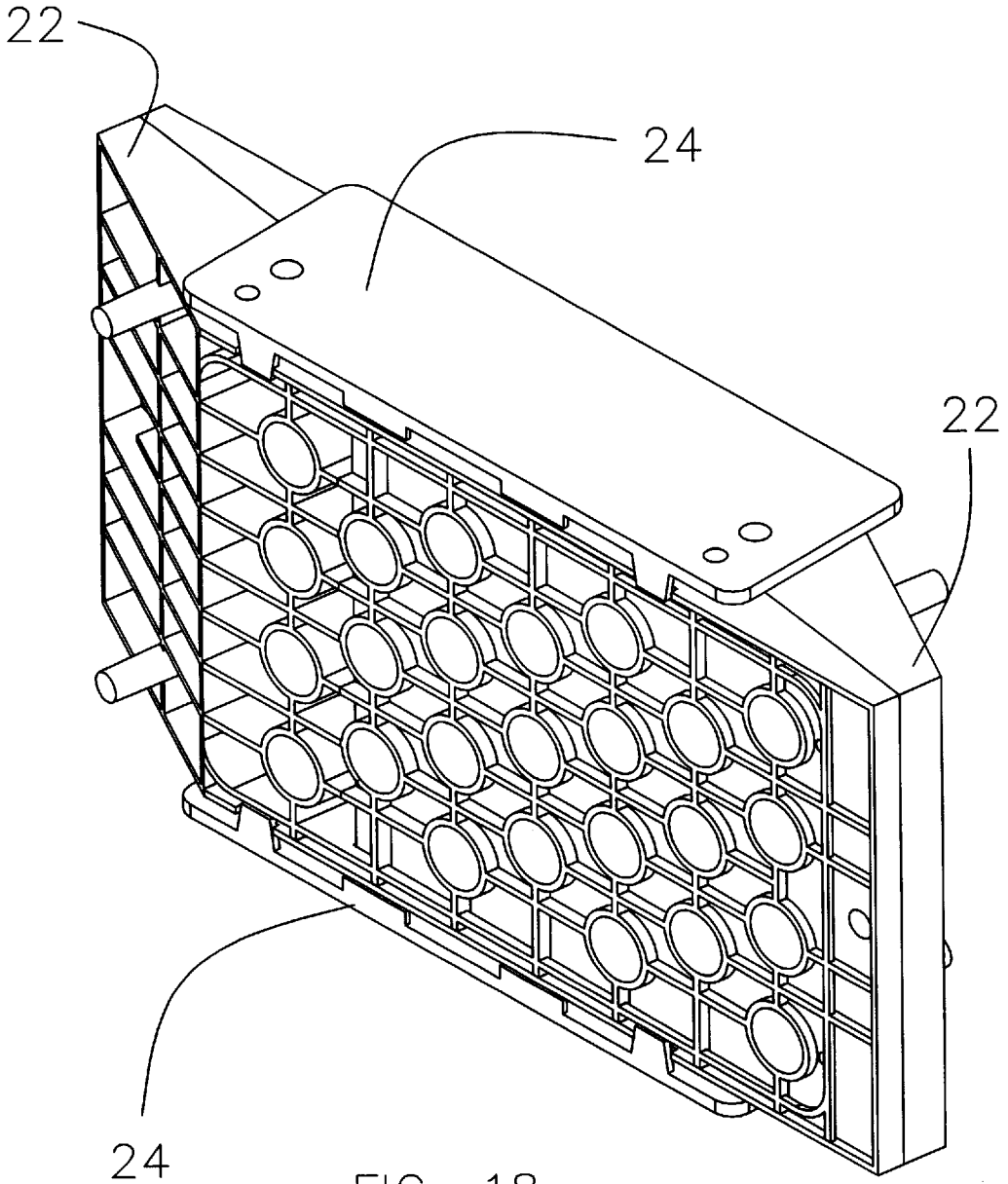
FIG. 18 is a perspective view of the improved vehicle ramp of FIG. 17 in a packed position.

The improved vehicle ramp of the invention is in various views in whole or in part in FIGS. 2–18, and is generally indicated in FIGS. 2–4, partially indicated in FIGS. 5–16, and fully shown assembled and disassembled in FIGS. 17–18. The improved vehicle ramp 20 is generally used in conjunction with a second ramp, where the ramps are spaced apart from one another in a known manner approximately of the same width as the vehicle so as to enable the front pair (or alternatively the back pair) of wheels on a vehicle 19 to be driven up an inclined portion of the ramp positioned in front of the respective wheel whereby the wheel will settle into a wheel retaining area on the top of the ramp as is discussed below in more detail.

Each ramp 20 includes a base ramp 21, a ramp extension 22, a ramp transition 23, and a base plate 24 (FIGS. 3–4). The ramp extension 22, ramp transition 23 and base plate 24 of each ramp 20 is storable in conjunction with an extension, transition, and base plate of a second ramp where the stored assembly is compact and readily movable as described below in more detail and shown in FIGS. 17–18.

Base ramp 20 as shown in FIGS. 3–4 is formed as a unitary sheet metal body stamped of flat sheet steel into the particular unique configuration shown in the drawings and described below. Ramp 20 includes an inclined ramp portion, a raised wheel rest portion, and a rear support portion, indicated generally at 30, 31 and 32, respectively. In general, this ramp 20 may be of any known design so long as it includes these three general elements 30–32 and any means compatible with ramp extension 22 and ramp transition 23 to allow the extension and transition to interlock with the ramp and each other as described below in more detail.

In the preferred embodiment as shown in FIGS. 2–4, ramp 20 is described in more detail in U.S. Pat. No. 5,324,004 and hereby incorporated by reference. Ramp 20 includes a track 35 separated by spaced apart side walls 36 and 37, all of which extend from inclined ramp portion 30 to rear support portion 32. A series of longitudinally spaced, transversely extending rows of bosses 40 are formed in track 35. The various bosses are similar to each other, each being formed as a raised frustro conical member having a conical sidewall with a top circular opening. The size, configuration, shape and other limitations of each boss and the overall configuration of the bosses may be of any of a variety of alternatives as long as the bosses are sized, configured and shaped to interact and receive the ramp extension 22 and ramp transition 23. As is shown in the FIGURES, one embodiment involves the individual bosses lying intermediate the pair of bosses in the longitudinally adjacent rows, as can be seen particularly in FIGS. 3 and 4. Also, it has been found that by alternating number of bosses in adjacent rows, namely three bosses in one row, then four bosses in the next row, and then three bosses etc. again provides increased strength with a minimum thickness of material.

The pair of side rails, indicated generally at 36 and 37, each extends continuously from the base of inclined ramp portion 30 along wheel rest portion 31 and downwardly along rear support portion 32. Rails 36 and 37 have an inverted U-shaped cross-sectional configuration, having a pair of side surfaces with a curved web wall therebetween.

Wheel rest portion 31 includes a generally flat planar surface which extends between a rear stop member indicated generally at 45, and a forward secondary stop member 46. Secondary stop 46 is located at and forms a portion of a transition zone, which is the area where inclined ramp portion 30 merges into and joins with flat planar wheel rest portion 31. Secondary stop 46 includes a downwardly and outwardly inclined wall which merges into the end of upper planar portion of wheel rest portion 31. A corner resists a vehicle wheel from rolling backwards and down along inclined ramp portion 30, after it has reached its at-rest position on raised wheel rest portion 31.

Figure 5:
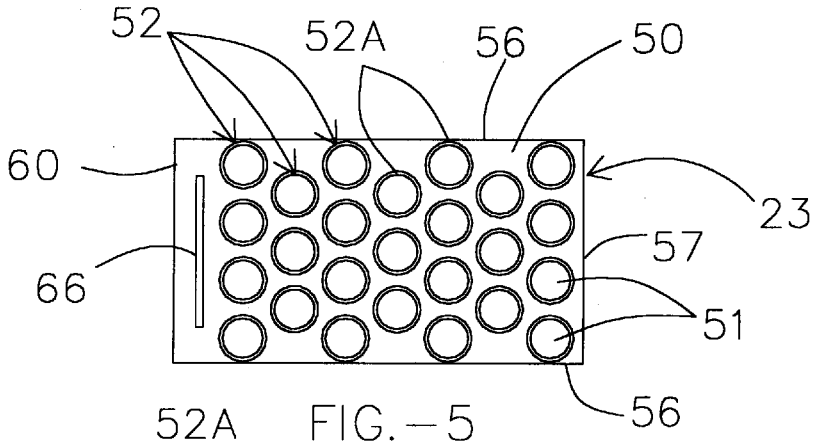
FIG. 5 is a top plan view of the ramp transition of FIGS. 2–4.
Figure 6:
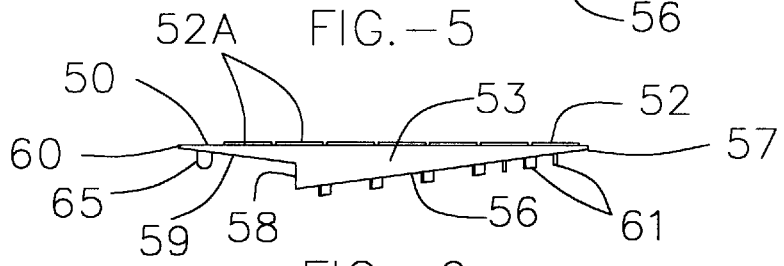
FIG. 6 is a side elevational view of the ramp transition of FIG. 5.
Figure 7:
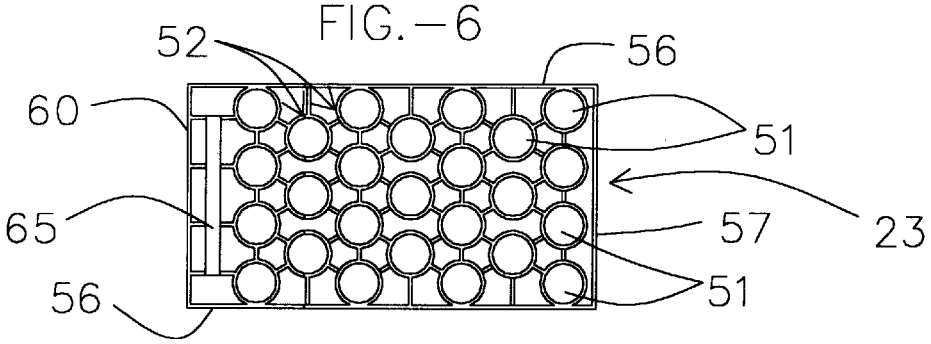
FIG. 7 is a bottom plan view of the ramp transition of FIGS. 5–6.
Figure 8:
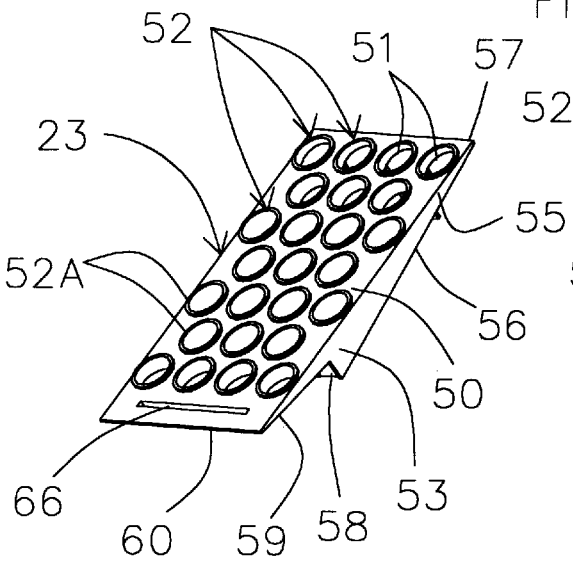
FIG. 8 is a top perspective view of the ramp transition of FIGS. 5–7.
Figure 9:
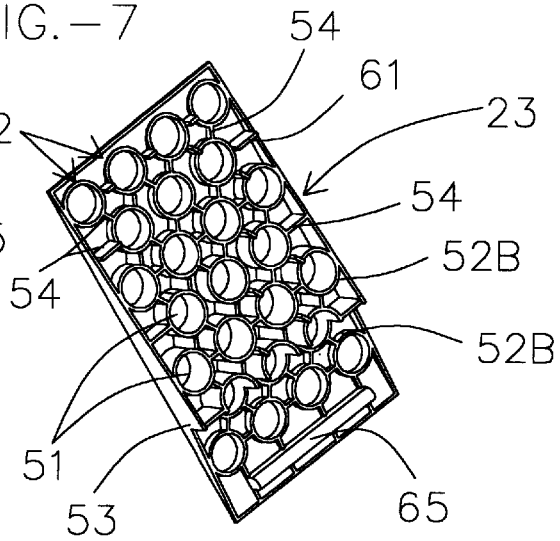
FIG. 9 is a bottom perspective view of the ramp transition of FIGS. 5–8.

Ramp transition 23, as shown in more detail in FIGS. 5–9, includes a generally planar top surface 50 having a plurality of large bosses 51 therein defined by cylindrical walls 52 that extend outward from surface 50 in both directions to form tubular ridges 52A in surface 50 as shown in FIGS. 5, 6, and 8, and tubular members 52B in a back cavity 49 behind surface 50 as described below. Ramp transition 23 also includes a pair of opposed side panels 53 extending from the back side of the surface 50 along opposing side edges 55 so as to define the above referenced back cavity 49 in which the bosses 51 extend. Each of the sides 53 includes one top side edge 55 planar with surface 50, a first bottom edge 56 extending angularly away from the top side edge 55 and an upper end 57 to a transverse edge 58, and a second bottom edge 59 extending angularly away from the top side edge 55 and a lower end 60 to the transverse end 57 which extends between edges 56 and 59 as is best shown in FIGS. 6, 8, and 9.

Opposed sides 53 and tubular members 52B are all interconnected by a web of strength walls 54. Some of the walls 54 are of the same depth as the bosses 51 while others extend beyond the outermost edge of the tubular members 52B along the back side as is best shown in FIGS. 6 and 9 and referred to as 61. Furthermore, each row of the tubular members 52B, where rows are defined as groups of aligned tubular members extending between top side edges 55, is of a varying height and more specifically, the heights of each row as well as each member 52B from front to back varies along a slope as defined by first and second bottom edges 56 and 59 from front lip or upper end 57 to transverse edge 58, and from back lip or lower end 60 to transverse edge 58, respectively, to the extent of even severing a row of tubular members along transverse edge 58 so as to be of substantially differing heights from front to back as shown in FIG. 9.

The bosses 51 are preferably configured such that any interior individual boss lies intermediate the pair of bosses in the longitudinally adjacent rows, as can be seen particularly in FIGS. 5 and 7–9. It is also shown that the adjacent rows include alternating numbers of bosses, namely three bosses in one row, then four bosses in the next row, and then three bosses, etc. This allows the walls 54 that extend beyond the bosses, which are in effect locking tabs 61 and best shown in FIG. 6, to be alignable with bosses 40 in ramp 20 so as to secure ramp transition 23 to ramp 20 as is shown in FIGS. 3–4 since these bosses 40 are also configured such that any interior boss 40 lies intermediate the pair of bosses in the longitudinally adjacent rows.

Ramp transition 23 further includes a locking bar 65 adjacent lower end 60 that extends outward from the back cavity of the ramp transition. The locking bar 65 is defined by a groove 66 extending into top surface 50.

Figure 10:
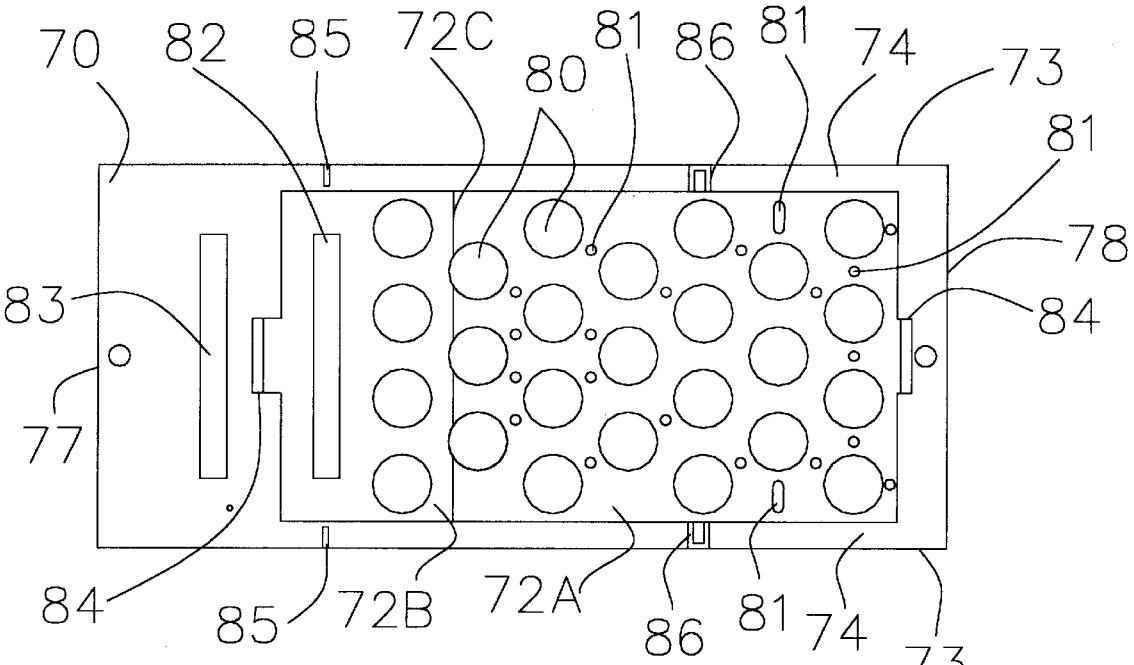
FIG. 10 is a top plan view of the ramp extension of FIGS. 2–4.
Figure 11:
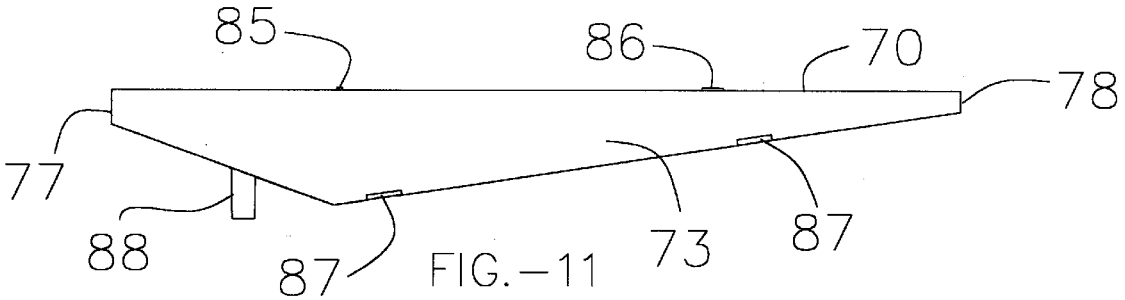
FIG. 11 is a side elevational view of the ramp extension of FIG. 10.
Figure 12:
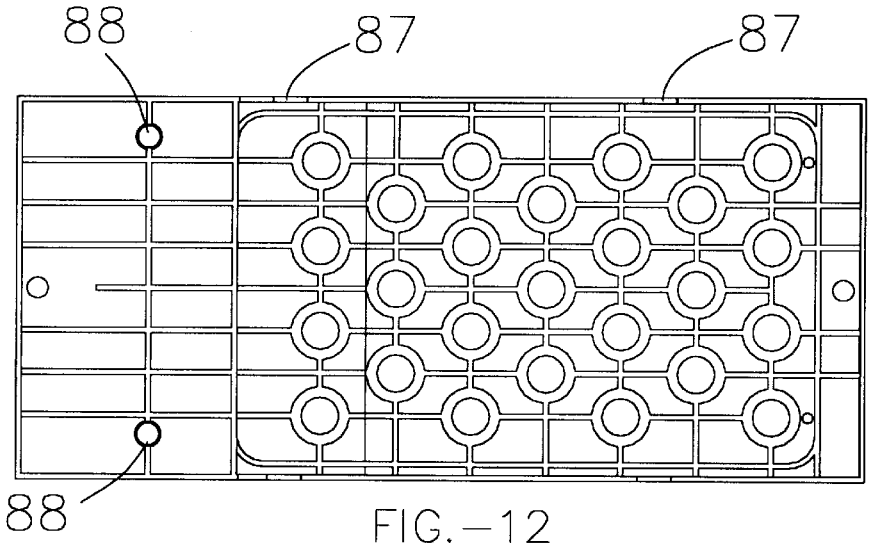
FIG. 12 is a bottom plan view of the ramp extension of FIGS. 10–11.
Figure 13:
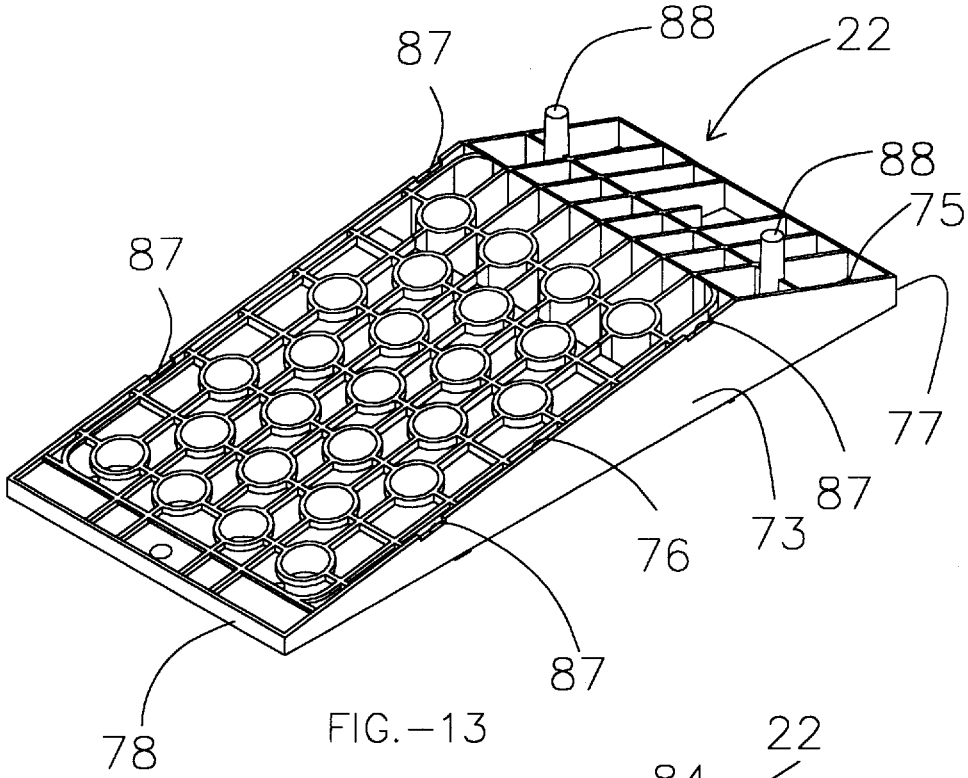
FIG. 13 is a bottom perspective view of the ramp extension of FIGS. 10–12.
Figure 14:
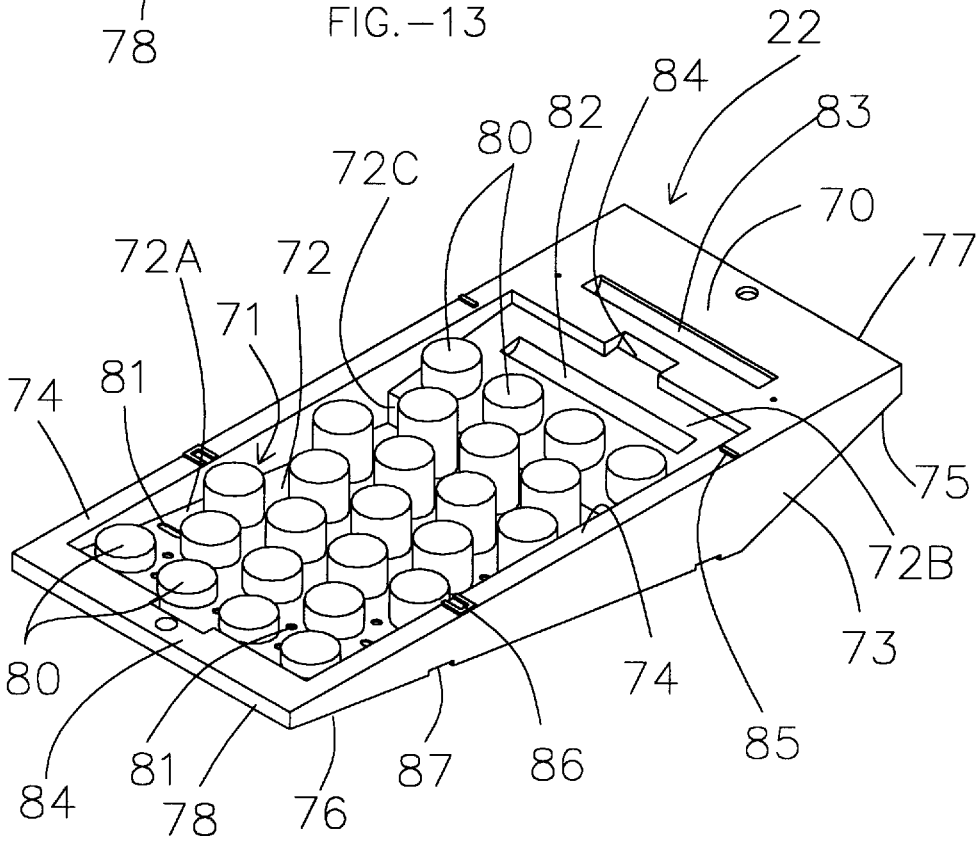
FIG. 14 is a top perspective view of the ramp extension of FIGS. 10–13.

Ramp extension 22, as shown in more detail in FIGS. 10–14, includes a generally planar top surface 70 with an indented center cavity 71 therein defining a lower surface or panel 72 having a first sloped surface 72A and a second sloped surface 72B separated by a transition surface 72C. The ramp extension 22 further includes a pair of opposed sides 73 with inner and outer surfaces extending from opposing top side edges 74 substantially the same depth as cavity 71 so as to define side walls of said cavity, and outer walls of the ramp extension 22. Sides 73 are of a substantially triangular shape as defined by top side edge 74, a first bottom side edge 75, and a second bottom side edge 76 where the bottom side edges are connected to the top side edge along short upper and lower ends, 77 and 78 respectively. The bottom side edges 75 and 76 are not parallel to top side edge 75 and are instead angularly extending away from the upper and lower ends 77 and 78, respectively, and toward each other to an outermost intersection point of the bottom side edges as is shown in FIGS. 11, 13, and 14.

A plurality of cylindrical supports 80 as shown in FIGS. 10 and 12–14 with hollow interiors as shown in FIG. 12 extend outward from panel 72 until approximately flush with top surface 70. Due to the sloped angle of surfaces 72A and 72B, these cylindrical supports 80 are of varying heights to maintain this approximately flush definition. The plurality of cylindrical supports 80 are preferably configured such that any interior individual cylindrical support lies intermediate the pair of cylindrical supports in the longitudinally adjacent rows, as can be seen particularly in FIGS. 10 and 14. It is also shown that the adjacent rows include alternating numbers of cylindrical supports, namely three cylindrical supports in one row, then four cylindrical supports in the next row, and then three cylindrical supports, etc.

The panel 72 is not a planar panel and instead is configured by angled surfaces 72A and 72B as a mirror of the first and second bottom edges 56 and 59 of the ramp transition 23 so as to selectively receive it as described below in more detail. Panel 72 includes a plurality of holes or slots 81 for receiving the locking tabs 61 when the ramp transition 23 seats in the ramp extension 22. Panel 72 also includes a groove 82 corresponding in size, configuration, arrangement, and shape to locking bar 65 so as to selectively receive said bar when a ramp transition is seated within cavity 71 as illustrated in FIGS. 17 and 18.

Ramp extension 22 further includes an alignment groove 83 in top planar surface 70 as shown in FIGS. 10 and 14 for selectively receiving locking bar 65 during use of the ramp 20 as shown in FIGS. 3 and 4. Ramp extension 22 also includes cut-outs 84 as also shown in FIGS. 10 and 14 at each end of the cavity 71 to allow for easier removal of a ramp transition 23 when seated therein. Ramp extension 22 further includes one lock slot 85 and one lock channel 86 on each top side edge 74 as shown in FIGS. 10 and 14 for alignment with corresponding slots and channels on another ramp extension during packaging/storage as shown in FIGS. 17 and 18. As shown in FIGS. 11–14, ramp extension 22 further includes locking notches 87 in bottom side edges 76 for selectively receiving base plate 24 during packaging/storage as is shown in FIGS. 17 and 18. Ramp extension 22 also includes pins 88 as shown in FIGS. 11–13 for hooking the short end of the ramp extension to the base ramp 21 via bosses 40 therein.

Base plate 24 is any plate of sufficient area for supporting an edge of the ramp that is susceptible to sinking or knifing as it is often referred to as. In the embodiment shown in FIGS. 15–16, the base plate 24 is a planar plate 90 having two sets of alignment pins, namely a first and second pair each including a large pin 91 and a smaller pin 92 with a gap 93 therebetween. The plate 90 also may include a guide line 94 of a substantially equivalent configuration as the ramp edge the plate is intended to support so as to guide the user in assembling and aligning the ramp on the plate. This guide line 94 extends through the gaps 93 and projects outward from planar plate 90 less than pins 91 and 92.

Base plate 24 also includes four locking tabs 95 extending transversely away from the outer edge of the plate 90, all in the same direction. These tabs 95 interact with the locking notches 87 on the pair of ramp extensions 22 during packaging and storage thereof as is shown in FIGS. 17 and 18. Each tab 95 as shown in FIGS. 15 and 16 includes an outer lip 96 that snaps over one of the notches to hold the pair of ramp extensions 22 together. The base plate 24 may also include guide tabs 99 for use to align during packaging.

In use as shown best in FIGS. 2–4, base ramp 21 is properly positioned as desired on the ground so as to elevate a vehicle when driven thereon. During this process, base plate 24 is properly positioned under the vertical end edge of the base ramp 21 as is shown in FIG. 4 whereby the vertical edge aligns with guide line 94 and is held in place in gap 93 in between the pair of pins 91–92. The ramp is now better supported so as to not be susceptible to knifing during loading.

Ramp extension 22 is then secured thereto by aligning pins 88 in the ramp extension with some of the bosses 40 in the base ramp 21 and inserting the pins therein. This secures the ramp extension to the base ramp 21 thereby extending the ramp 20. The ramp transition 23 is next aligned such that locking bar 65 is aligned with groove 83 and transverse edge 58 with upper end 77. The ramp transition is then secured to the ramp extension 22 and on top of the base ramp 21 as is shown in FIG. 4.

In use, typically two ramps are used side by side so as to elevate one entire end of a vehicle. Therefore, a second set should be assembled identical to the above description for the first set. The ramp or ramps are now ready for use as they are longer and thus of a more gradual slope making them less likely to interfere with the vehicle spoiler during the driving of the vehicle thereon, and less likely to slide during the initial interaction of the vehicle tires with the ramp. The base plate has also alleviated the knifing problem.

In packaging or storage, the ramp transitions 23 seat within the cavity 71 of the ramp extensions 22. This is shown in an exploded view in FIG. 17. Specifically, locking bar 65 is aligned with groove 82 and bosses 51 with cylinders 80 whereby the transition 23 seats in the extension 22. The extensions 22 are then aligned head-to-toe with each other to form a somewhat rectangular structure as is shown in FIG. 18. The back plates 24 then snap over the sides of the abutted extensions 22 whereby the locking tabs 95 snap into the notches 87 thereby securing the whole package together for storage absent the base ramps 21 which may be sold therewith or alternatively may be a prior art pair of ramps so long as it has the proper bosses therein to align with the pins and the proper slopes to receive the extension and transition.

In manufacturing, the ramp extension 22, ramp transition 23, and base plate 24 may be manufactured of any material including plastics and metals, although high strength plastic is preferred because of its lesser weight. One specific type of plastic that may be used is polyethylene for it is much lighter than metal and is of sufficient strength, in all temperatures, to be loaded as necessary during vehicle elevation when constructed as shown in the FIGURES. As to the base ramp, this ramp may also be of any material including plastics and metals.

Accordingly, the improved vehicle ramp is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved vehicle ramp is constructed and used, the characteristics of the construction, and the advantageous, new and useful results obtained; the new and useful structures, devices, elements, arrangements, parts and combinations, are set forth in the appended claims.

We claim:

1. A vehicle ramp system comprising:

a ramp for elevating a vehicle having an inclined ramp surface, a raised wheel rest surface, and a rear support;

a ramp extension selectively positionable against the inclined ramp surface for extending the incline the vehicle must traverse to reach the raised wheel rest surface; and a ramp transition selectively positionable over a portion of each of the ramp and the ramp extension for providing a more gradual transition from the ramp extension to the inclined ramp surface.

2. The vehicle ramp system of claim 1 wherein the ramp extension includes an extension securing mechanism for securably holding the ramp extension from sliding movement in relation to the inclined ramp surface of the ramp during use.

3. The vehicle ramp system of claim 2 wherein the extension securing mechanism includes a plurality of pins alignable with and each selectively receivable within one of a plurality of bosses within the inclined ramp surface for securably holding the ramp extension from sliding movement in relation to the inclined ramp surface of the ramp during use.

4. The vehicle ramp system of claim 1 wherein the inclined ramp surface is of a first grade while the ramp extension includes an inclined ramp extension surface of a second grade that is less steep than the first grade of the inclined ramp surface.

5. The vehicle ramp system of claim 4 wherein the ramp transition includes a transition surface of a third grade in between the first and second grades.

6. The vehicle ramp system of claim 4 wherein the inclined ramp extension surface includes a plurality of cylindrical supports positioned within a cavity defined within the inclined ramp extension surface whereby the outermost portions of the cylindrical supports are planar with the inclined ramp extension surface.

7. The vehicle ramp system of claim 1 wherein the ramp transition includes a plurality of holes positioned so as to allow the ramp transition to be storable within a ramp transition receiving cavity in the ramp extension.

8. The vehicle ramp system of claim 7 wherein the inclined ramp extension surface includes a plurality of cylindrical supports positioned within the ramp transition cavity defined within the inclined ramp extension surface whereby the plurality of cylindrical supports align with the plurality of holes thereby allowing the ramp transition to be stored within the ramp transition cavity.

9. The vehicle ramp system of claim 8 wherein the ramp extension includes a first slot within the ramp transition cavity and a second slot parallel to the first slot but outside of the ramp transition cavity, and where the ramp transition includes an elongated bar for selective insertion into the first slot during storage and into the second slot during use.

10. The vehicle ramp system of claim 1 further comprising a base plate of a substantially planar configuration for receiving the rear support.

11. The vehicle ramp system of claim 10 wherein the substantially planar base plate is transversely positioned in relation to the substantially vertical rear support during use of the ramp system.

12. The vehicle ramp system of claim 10 wherein the base plate includes two spaced apart pair of alignment pins with a gap extending therebetween for receiving the rear support.

13. The vehicle ramp system of claim 10 wherein the base plate includes a plurality of locking tabs extending outward from the planar base plate for selective locking of two abutted ramp extensions.

14. The vehicle ramp system of claim 13 wherein the ramp extension includes at least one set of alignment protrusions thereon for interaction with alignment protrusions on a second ramp extension.

15. A vehicle ramp system comprising:

a unitary ramp having an inclined ramp surface, a raised wheel rest surface, and a rear support; and a ramp extension selectively securable to a mid-section of the inclined ramp surface and having an inclined extension surface of a lesser incline than the inclined ramp surface.

16. The vehicle ramp system of claim 15 further comprising a ramp transition selectively securable over a portion of each of the ramp and the ramp extension for providing a more gradual transition from the inclined extension surface to the inclined ramp surface.

17. The vehicle ramp system of claim 15 further comprising a base plate on which the rear support rests to prevent knifing of the rear support.

18. A vehicle ramp modification package for use with a pair of standard ramps for elevating a vehicle having an inclined ramp surface, a raised wheel rest surface, and a rear support, the package comprising:

a pair of ramp extensions, each ramp extension includes an inclined ramp extension surface having a plurality of cylindrical supports positioned within a cavity defined within the inclined ramp extension surface whereby the outermost portions of the cylindrical supports are planar with the inclined ramp extension surface, whereby the ramp extension is selectively positionable against the inclined ramp surface for reducing the grade along at least a portion of the inclined ramp surface by extending the incline the vehicle must traverse to reach the raised wheel rest surface thereby eliminating vehicle-ramp interference;

a pair of ramp transitions, each ramp transition includes a transition surface for smoothly transitioning from the inclined ramp extension surface to the inclined ramp surface when the ramp transition is selectively positionable over a portion of each of the ramp and the ramp extension for providing a more gradual transition from the ramp extension to the inclined ramp surface, and each ramp transition further includes a plurality of holes selectively alignable with the plurality of cylindrical thereby allowing the ramp transition to be stored within the ramp transition cavity; and a pair of base plates, each base plate including a plurality of locking tabs extending outward from the planar base plate for selective locking of the pair of ramp extensions when the extensions are abutted against one another.

19. The vehicle ramp modification package of claim 18 wherein each ramp extension includes at least one set of alignment protrusions thereon for interaction with alignment protrusions on the other ramp extension so as to assure proper alignment of the ramp extensions when abutted prior to locking together using the base plates.

20. The vehicle ramp modification package of claim 18 wherein each ramp extension includes a first slot within the cavity and a second slot parallel to the first slot but outside of the cavity, and where the ramp transition includes an elongated bar for selective insertion into the first slot during storage and into the second slot during use.

* * * * *